US010792939B2

(12) United States Patent
Oguchi et al.

(10) Patent No.: US 10,792,939 B2
(45) Date of Patent: Oct. 6, 2020

(54) PRINTER APPARATUS WITH FLAPPER ATTACHED TO CONVEYING ROUTE COVER

(71) Applicant: FUJITSU COMPONENT LIMITED, Tokyo (JP)

(72) Inventors: Tatsuya Oguchi, Tokyo (JP); Sumio Watanabe, Tokyo (JP); Masahiro Tsuchiya, Tokyo (JP); Tetsuhiro Ishikawa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 204 days.

(21) Appl. No.: 15/662,559

(22) Filed: Jul. 28, 2017

(65) Prior Publication Data

US 2017/0320340 A1 Nov. 9, 2017

Related U.S. Application Data

(63) Continuation of application No. 14/043,924, filed on Oct. 2, 2013, now abandoned.

(30) Foreign Application Priority Data

Oct. 31, 2012 (JP) ..... 2012-241055

(51) Int. Cl.

| | |
|---|---|
| ***B41J 11/00*** | (2006.01) |
| ***B41J 11/66*** | (2006.01) |
| ***B41J 15/00*** | (2006.01) |

(52) U.S. Cl.
CPC ..... *B41J 11/66* (2013.01); *B41J 11/006* (2013.01); *B41J 15/005* (2013.01)

(58) Field of Classification Search
CPC ..... B41J 11/66; B41J 11/70; B41J 15/005; B65H 20/32; B65H 2301/51212;
(Continued)

(56) References Cited

U.S. PATENT DOCUMENTS 5,588,762 A 12/1996 Suzuki
5,602,636 A 2/1997 Matsuzawa
(Continued)

FOREIGN PATENT DOCUMENTS

CN 102848740 1/2013
EP 1063094 A1 * 12/2000 ..... B41J 11/703
(Continued)

*Primary Examiner* — Blake A Tankersley
(74) *Attorney, Agent, or Firm* — IPUSA, PLLC

(57) ABSTRACT

A printer including a printing part which prints on a recording paper; a cutter part which cuts the recording paper; and a conveying part which includes a conveying route having a curving shape and through which the recording paper conveyed through the cutter part is conveyed; a conveying route cover which is attached to the conveying part and covers a portion of the conveying route; and a flapper which is provided at a curved portion of the conveying route, has a curved shape, and is rotatably attached to the conveying route cover so as to rotatably open or close relative to a main body of the printer, wherein the conveying route cover and the flapper are movable together so as to separate from or contact the main body.

3 Claims, 15 Drawing Sheets

(58) Field of Classification Search
CPC ..... G03G 15/6558; G03G 15/6567; G03G 15/657; G03G 15/6573; G03G 2215/00552; G03G 15/234
See application file for complete search history.

(56) References Cited

U.S. PATENT DOCUMENTS

| | | | | |
|---|---|---|---|---|
| 5,649,776 | A | 7/1997 | Sugimoto et al. | |
| 5,893,657 | A | 4/1999 | Matsuzawa | |
| 5,954,438 | A | 9/1999 | Klein et al. | |
| 6,428,226 | B1 | 8/2002 | Suzuki et al. | |
| 6,504,331 | B1 | 1/2003 | Longrod | |
| 6,814,515 | B2 | 11/2004 | Tsuchiya et al. | |
| 6,889,031 | B2 | 5/2005 | Tsuchida | |
| 6,961,526 | B2 * | 11/2005 | Tezuka | G03G 15/5062 399/15 |
| 7,857,534 | B2 | 12/2010 | Watanabe et al. | |
| 2004/0022565 | A1 * | 2/2004 | Tomono | G03G 15/234 399/401 |
| 2007/0071524 | A1 * | 3/2007 | Nakamura | G03G 15/234 399/341 |

FOREIGN PATENT DOCUMENTS

| | | |
|---|---|---|
| EP | 2407312 | 1/2012 |
| JP | S61-246082 | 11/1986 |
| JP | H09-323854 | 12/1997 |
| JP | H10-052956 | 2/1998 |
| JP | 2002-207259 | 7/2002 |
| JP | 2003-019845 | 1/2003 |
| JP | 2005-088305 | 4/2005 |
| JP | 2007-130842 | 5/2007 |
| WO | 2012/110981 | 8/2012 |

* cited by examiner

PRINTER APPARATUS WITH FLAPPER ATTACHED TO CONVEYING ROUTE COVER

CROSS-REFERENCE TO RELATED APPLICATIONS

This patent application is a continuation application of and claims the benefit of priority under 35 U.S.C. 120 to patent application Ser. No. 14/043,924 filed on Oct. 2, 2013, which is based upon and claims priority to Japanese Patent Application No. 2012-241055 filed on Oct. 31, 2012. The entire contents of each of these applications are incorporated herein by reference.

BACKGROUND OF THE INVENTION

1. Field of the Invention

The present invention relates to a printer apparatus.

2. Description of the Related Art

A printer issuing a receipt or the like may be widely used for a cash register in a shop or the like, and an automated teller machine (ATM), a cash dispenser (CD) or the like in a bank or the like. Such a printer issuing the receipt or the like prints on a recording paper using a thermal head or the like while conveying a thermal paper as a recording paper. After conveying the recording paper for a predetermined length, the recording paper having the predetermined length is cut by a cutter.

A presenter for conveying the recording paper cut by the cutter may be provided in printers issuing the receipt or the like. By providing the presenter, printed recording paper enters into the presenter is cut inside the presenter, and is ejected through the presenter. Thus, the ejected and printed recording paper is extracted.

Besides the function as the presenter, the presenter may have the function as a retractor provided to retrieve the recording paper in order to prevent the receipt of the like from being used by somebody else when the ejected recording paper is forgotten to be taken.

[Patent Document 1] Japanese Laid-open Patent Publication No. 2003-19845

[Patent Document 2] Japanese Laid-open Patent Publication No. 2007-130842

[Patent Document 3] Japanese Laid-open Patent Publication No. H-1052956

SUMMARY OF THE INVENTION

According to an aspect of the embodiments of the present invention, there is provided a printer including a printing part which prints on a recording paper; a cutter part which cuts the recording paper; and a conveying part which includes a conveying route having a curving shape and through which the recording paper conveyed through the cutter part is conveyed; a conveying route cover which is attached to the conveying part and covers a portion of the conveying route; and a flapper which is provided at a curved portion of the conveying route, has a curved shape, and is rotatably attached to the conveying route cover so as to rotatably open or close relative to a main body of the printer, wherein the conveying route cover and the flapper are movable together so as to separate from or contact the main body.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DESCRIPTION OF EMBODIMENTS

In a printer apparatus provided with a presenter, the printer apparatus is enlarged by the size of the presenter. Especially, when the presenter cuts a recording paper for each long length, the size of the presenter is large in conformity with the length of the recording paper to be cut. Therefore, the size of the printer apparatus becomes very large.

Figure 1:
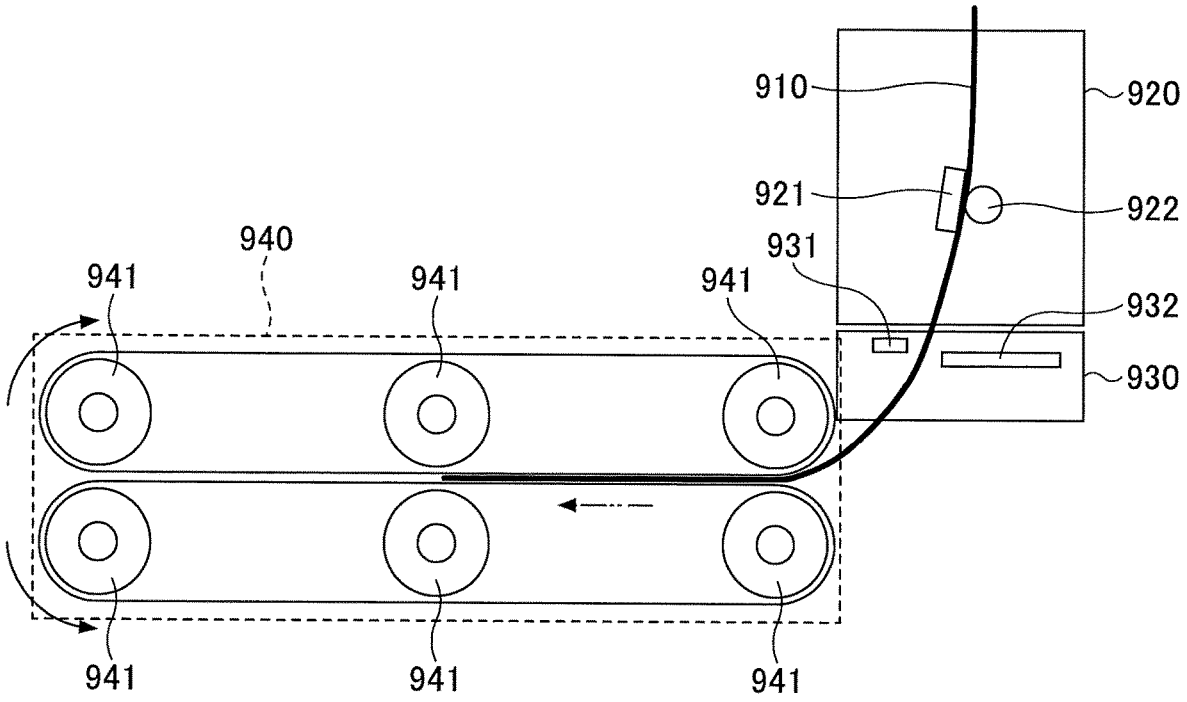
FIG. 1 illustrates a part of an exemplary printer apparatus.

An exemplary printer apparatus illustrated in FIG. 1 includes a printing part 920, a cutter 930, and a presenter 940. In the printer apparatus, the printing part 920 includes a thermal head 921 and a platen roller 922. The cutter 930 includes a fixed blade 931 and a movable blade 932 for cutting the recording paper 910. The presenter 940 includes rollers 941 for conveying the recording paper 910. In this printer apparatus, depending on the length of the recording paper 910 to be cut, it is necessary to elongate the conveying route length of the recording paper 910 in the presenter 940. Along with this, the size of the presenter 940 is enlarged. Therefore, the size of the printer apparatus becomes large.

A description of embodiments of the present invention is given below. Where the same reference symbols are attached to the same parts, repeated description of the parts is omitted.

First Embodiment

Figure 2:
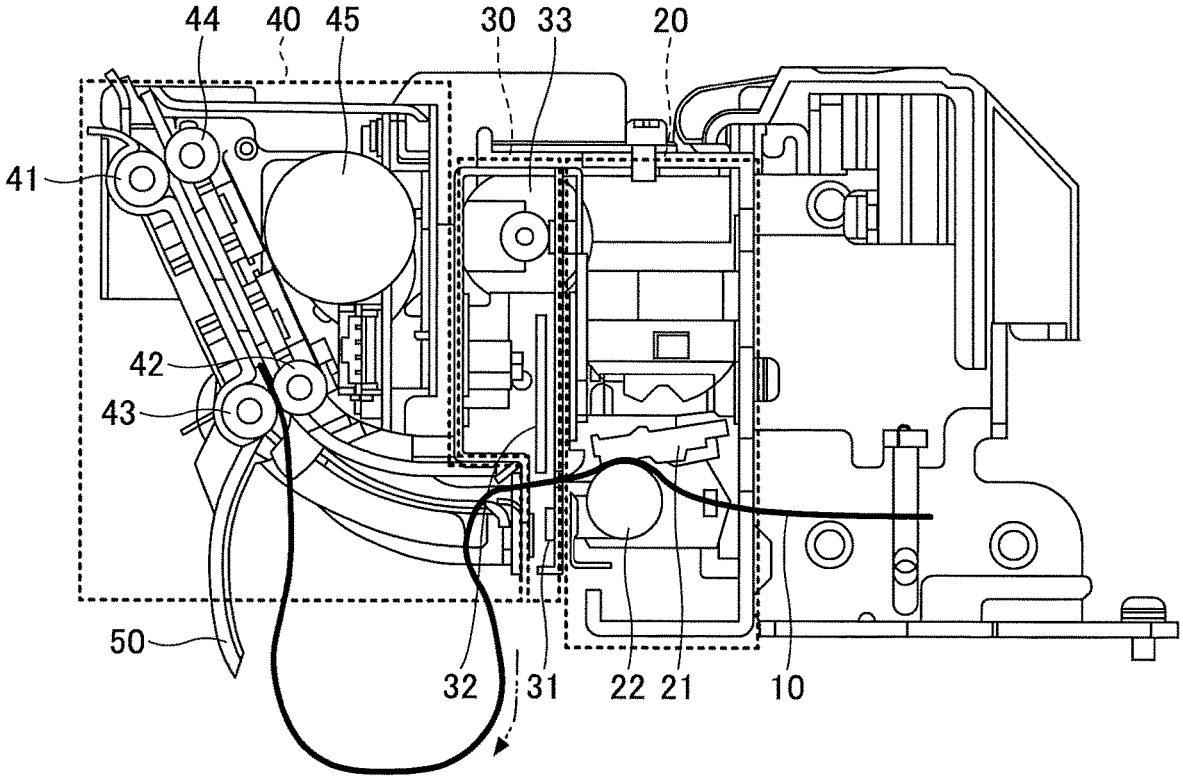
FIG. 2 illustrates a structure of a printer apparatus of a first embodiment.

The structure of a printer apparatus of a first embodiment is described. Referring to FIG. 2, the printer apparatus of the first embodiment includes a printing part 20 for printing characters or the like on the recording paper 10, a cutter part 30 for cutting the recording paper 10, and a conveying part 40 for conveying the recording paper 10 ejected from the cutter part 30.

The printing part 20 includes a thermal head 21 and a platen roller 22. Characters or the like are printed on the recording paper 10 by the thermal head 21 while the recording paper 10 is sandwiched between the thermal head 21 and the platen roller 22. Because the recording paper 10 is ejected from the printer while the printing surface faces upward, the thermal head 21 is positioned above the recording paper 10.

The cutter part 30 includes a fixed blade 31 and a movable blade 32 for cutting the printed recording paper 10. The recording paper 10 passing through the fixed blade 31 and the movable blade 32 is cut by the fixed blade 31 and the movable blade 32 to have a predetermined length. A motor 33 is provided to upward and downward drive the movable blade 32.

The conveying part 40 is installed in the latter stage of the cutter part 30 and conveys the recording paper 10. The conveying part 10 includes rollers 41, 42, 43, and 44 for conveying the recording paper 10. By driving a motor 45, the rollers 41, 42, 43, and 44 are rotated to convey the recording paper 10. A flapper 50 is provided in the conveying part 40, between the cutter part 30 and the rollers 41, 42, 43, and 44. The flapper 50 is a lid which can be opened or closed. The flapper 50 is attached to the conveying part 40 so as to rotate around a rotary shaft (not illustrated). The flapper 50 is opened or closed by rotating around the rotary shaft. In the printer apparatus of the first embodiment, the flapper 50 forms a conveying route of the recording paper 10. When the flapper 50 is opened, a part of the conveying route of the recording paper 10 is opened.

In the printer apparatus of the first embodiment, when the flapper 50 is opened, the recording paper 10 conveyed in the conveying part 40 can be extracted so as to slack downward toward the outside of the conveying part 40. Since the recording paper 10 can be extracted so as to slack downward toward the outside of the conveying part 40, it is possible to cut the recording paper 10 so as to have a long length without using a presenter having a long conveying route. Therefore, even though the body size of the printer apparatus is small, the long recording paper 10 can be ejected.

Figure 3:
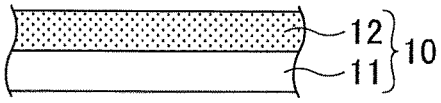
FIG. 3 illustrates a structure of a recording paper.

Ordinarily, the recording paper 10 used for a thermal printer is a thermal paper colored with heat applied by the thermal head 21. As illustrated in FIG. 3, the thermo-sensitive layer 12 is formed on the surface of a paper 11. When the recording paper 10 is conveyed under a state that a printed surface faces upward, namely the thermo-sensitive layer 12 is directed upward, the thermal head 21 is provided on an upper side facing the side of the recording paper 10 where the thermo-sensitive layer 12 is formed. In the first embodiment, the surface of the recording paper 10 where the thermo-sensitive layer 12 is formed is referred to as a "first surface" and the back surface of the recording paper 10 is referred to as a "second surface".

In the first embodiment, because the recording paper 10 is downward slackened, the thermo-sensitive layer 12 of the recording paper 10 does not contact components of the conveying part 40. Therefore, the thermo-sensitive layer 12 does not contact components of the conveying part 40 and does not rub against the components of the conveying part 40. Thus, the thermo-sensitive layer 12 is not colored by the rub.

(Method of Printing on Recording Paper)

Figure 4:
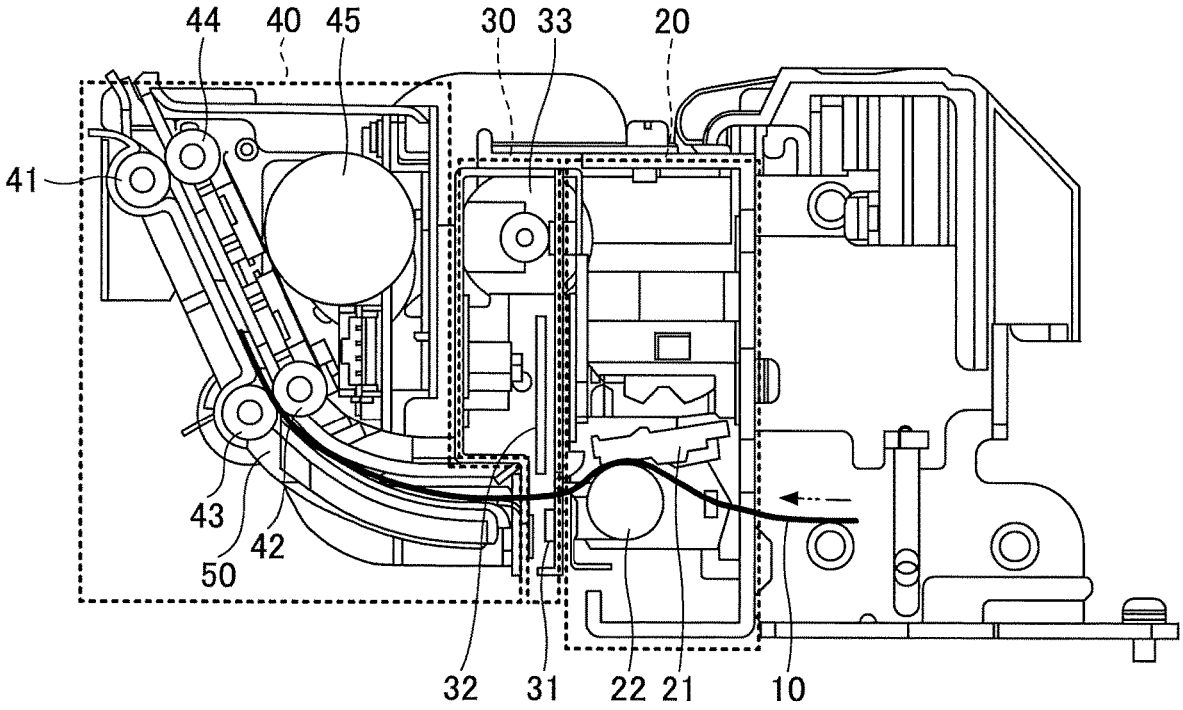
FIG. 4 illustrates a structure of the printer apparatus of the first embodiment.

A method of printing on a recording paper with a printer apparatus of the first embodiment is described next. Referring to FIG. 4, a case where the recording paper 10 ejected from the printer apparatus is short is explained. In this case, the recording paper 10 is cut by the cutter part 30 for a short length. Therefore, the recording paper 10 is conveyed while the flapper 50 of the conveying part 40 is closed. At this time, the flapper 50 has a function as a guide to convey the recording paper 10 and prevents the recording paper from jamming or folding.

Figure 5:
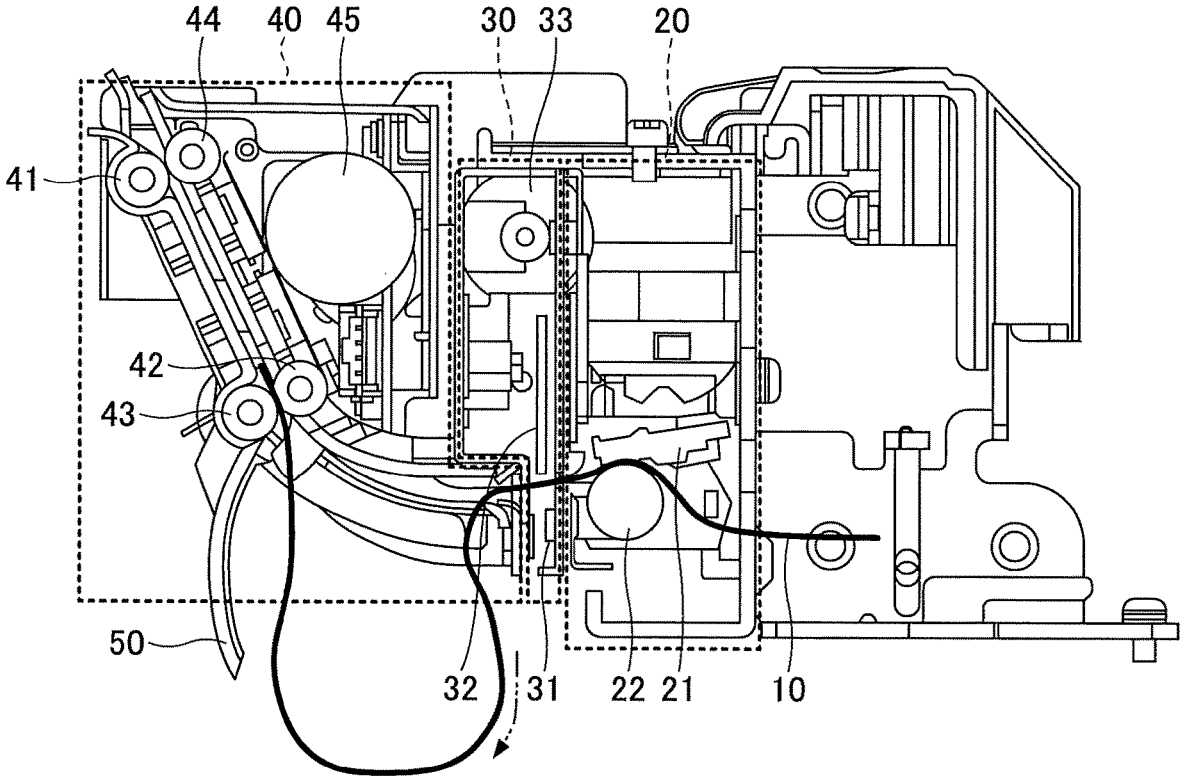
FIG. 5 illustrates the structure of the printer apparatus of the first embodiment.

Referring to FIG. 5, a case where the recording paper 10 ejected from the printer apparatus is long is explained. In this case, as the recording paper 10 is cut for the long length by the cutter part 30, the recording paper 10 is moved to an outside of the conveying part 40 and slacks downward while the flapper 50 of the conveying part 40 is opened. Because the recording paper 10 moves outside the conveying part 40 and slacks, the recording paper 10 can be cut for the long length. The flapper 50 may be opened by the weight of the recording paper 10 or may be opened by a motor or the like (not illustrated).

(Retracting)

Figure 6:
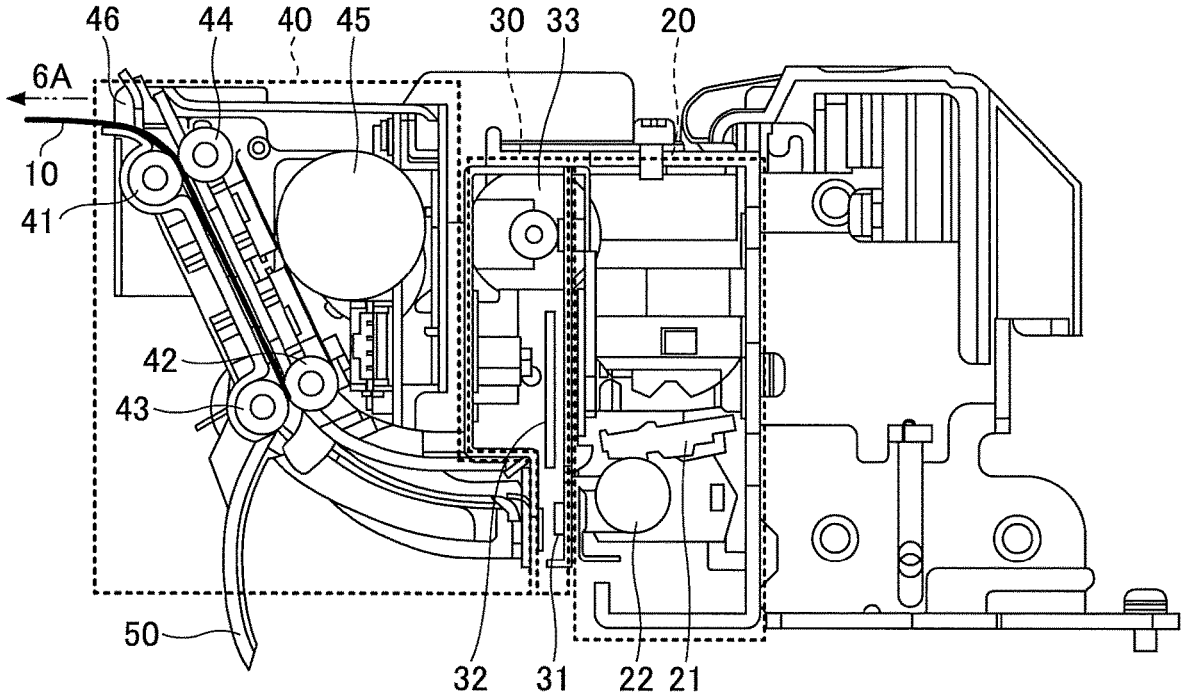
FIG. 6 illustrates the structure of the printer apparatus of the first embodiment.

Next, a case where a retracting operation is performed in the printer apparatus of the first embodiment is described. The recording paper 10 is conveyed to the conveying part 40 after the thermal printer 21 of the printing part 20 prints on the recording paper 10. After the recording paper 10 is conveyed towards the conveying part 40, the recording paper 10 is cut for a predetermined length by the fixed blade 31 and the movable blade 32. As illustrated in FIG. 6, the cut recording paper 10 is conveyed toward a recording paper ejecting port 46 of the conveying part 40 by the rollers 41, 42, 43, and 44. A series of printing operations is completed when a person extracts the recording paper 10 conveyed to the recording paper ejecting port 46 in a direction indicated by an arrow 6A. However, if a person does not extract the recording paper 10 conveyed to the recording paper ejecting port 46, the recording paper 10 is retrieved to prevent another person from extracting the recording paper 10.

Figure 7:
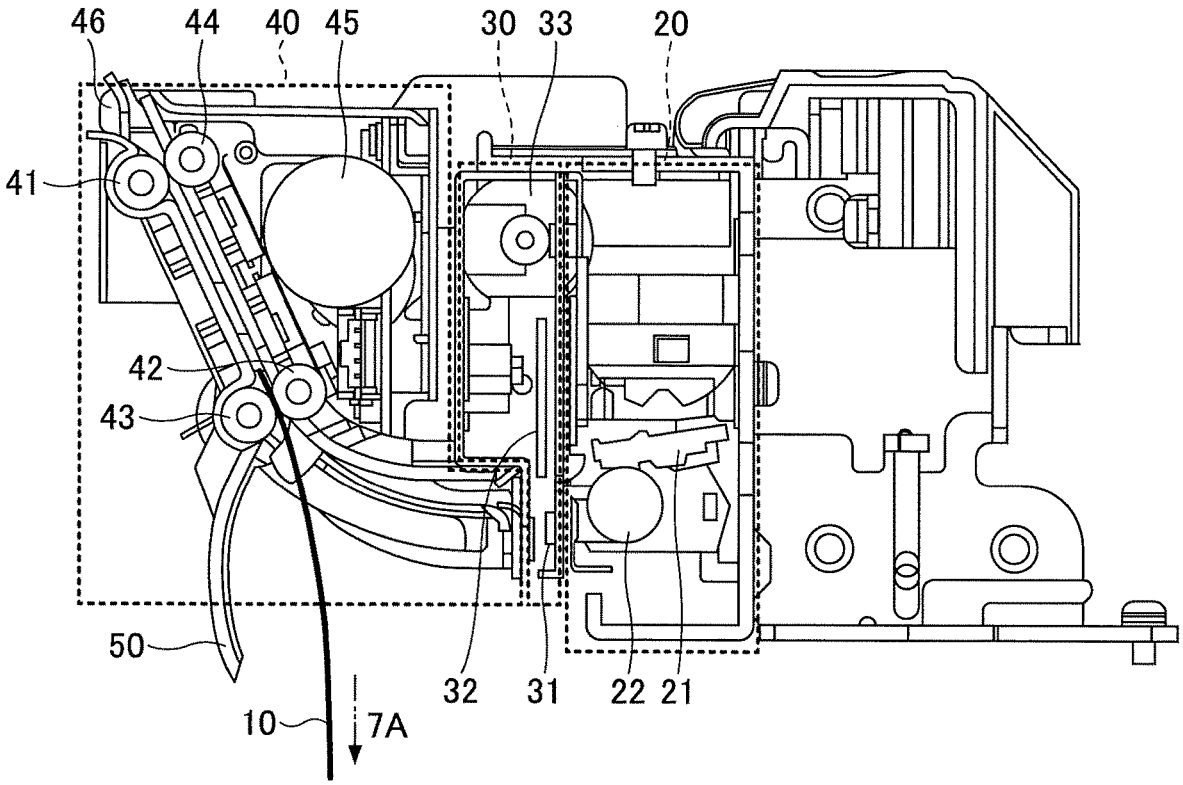
FIG. 7 illustrates the structure of the printer apparatus of the first embodiment.

In this case, as illustrated in FIG. 7, the rollers 41, 42, 43, and 44 of the conveying part 40 are inversely rotated. At this time, the flapper 50 is opened so that the recording paper 10 is conveyed in the direction indicated by an arrow 7A to retrieve the recording paper 10. Referring to FIGS. 6 and 7, the flapper 50 may be opened by a motor or the like (not illustrated).

(Flapper)

Figure 8B:
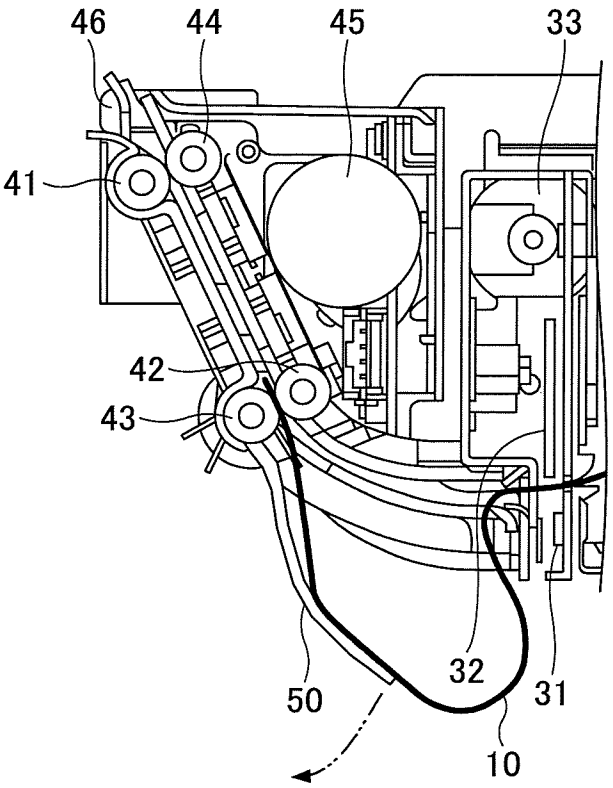
FIGS. 8A and 8B illustrate a flapper of the printer apparatus of the first embodiment.
Figure 8A:
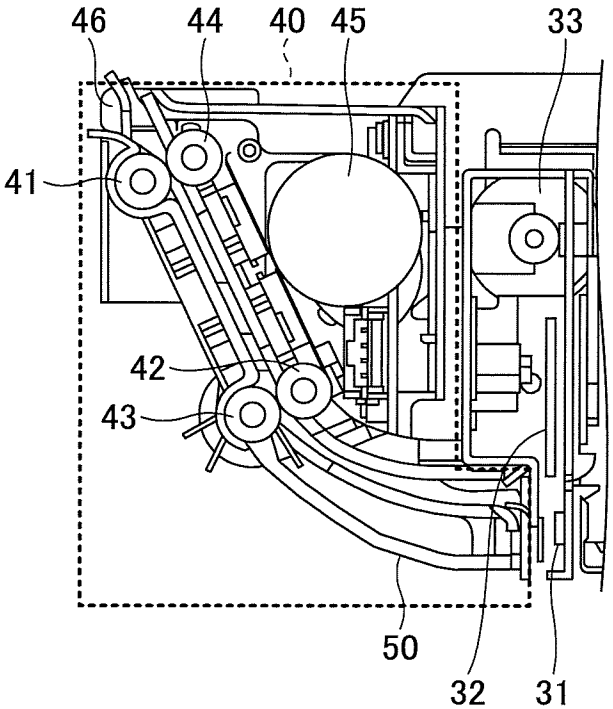

Next, the flapper 50 is described in detail. FIG. 8A illustrates a condition where the flapper 50 is closed, and FIG. 8B illustrates a condition where the flapper is opened. The flapper 50 may be formed by an elastic material such as a film made of a resin material. In a case where the recording paper 10 is cut for a long length, the recording paper 10 is slackened between the rollers 41, 42, 43, and 44 and the cutter part 30, as the flapper 50 is pushed by the weight of the recording paper 10. Referring to FIG. 8B, the flapper 50 opens to slacken the recording paper 10. After the recording paper 10 is ejected from the printer, because the recording paper 10 pushing the flapper 50 with the weight of the recording paper 10 disappears, the flapper 50 is automatically closed. The flapper 50 is closed in FIG. 8A, and the flapper gear is opened in FIG. 8B.

Figure 9B:
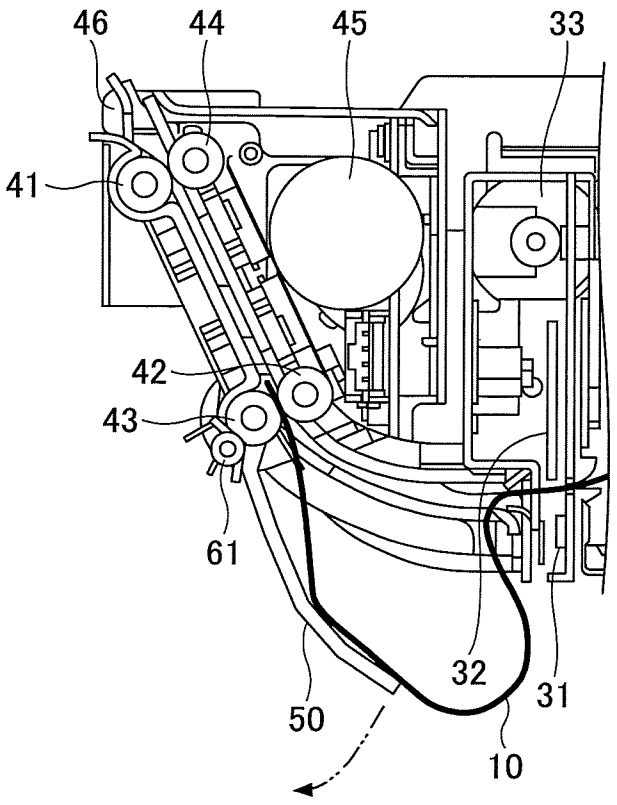
FIGS. 9A and 9B illustrate the flapper of the printer apparatus of the first embodiment.
Figure 9A:
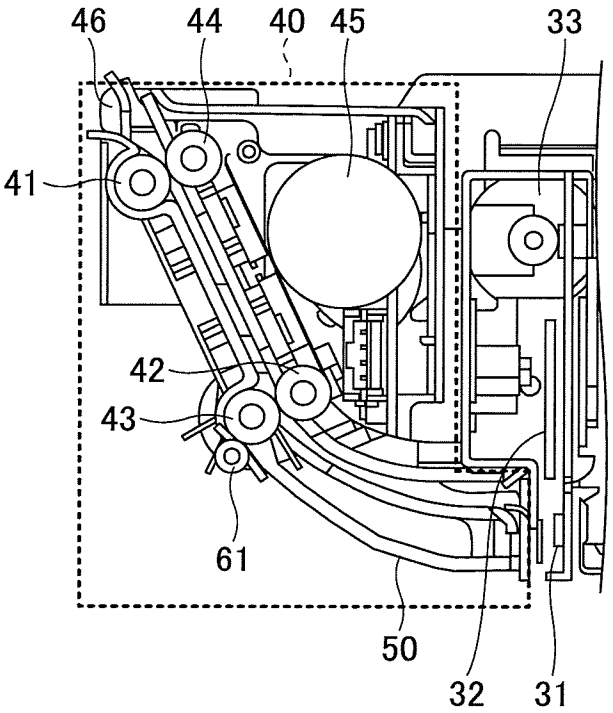

Referring to FIGS. 9A and 9B, a helical spring 61 as an elastic body may be provided at a portion where the flapper 50 is connected with the conveying part 40. In a case where the recording paper 10 is cut for the long length, the recording paper 10 is slackened between the rollers 41, 42, 43, and 44 and the cutter part 30. The flapper 50 is pushed by the weight of the recording paper 10 against a restoring force of the helical spring 61. Referring to FIG. 9B, the flapper 50 opens to slacken the recording paper 10. After the recording paper 10 is ejected, because the recording paper 10 pushing the flapper 50 with its weight disappears, the flapper 50 is closed by the restoring force of the helical spring 61. FIG. 9A illustrates the flapper 50 closed, and FIG. 9B illustrates the flapper opened.

Figure 10B:
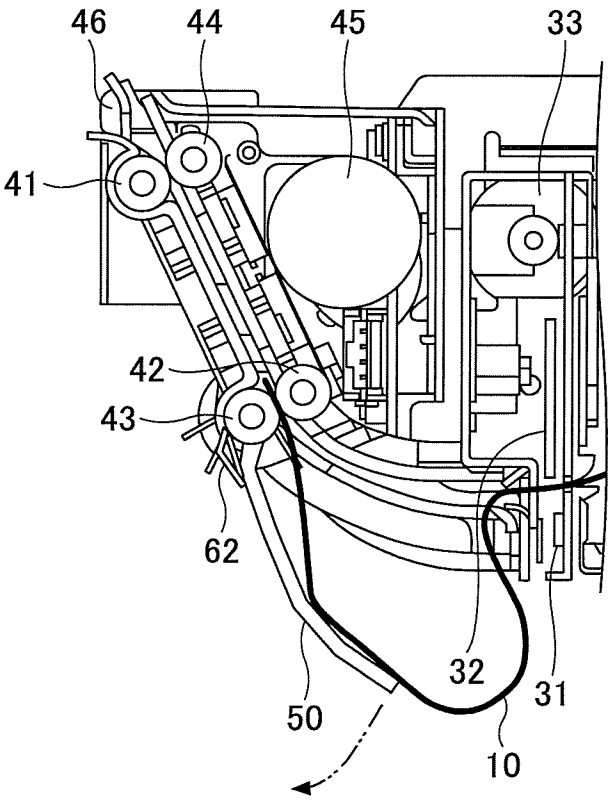
FIGS. 10A and 10B illustrate the flapper of the printer apparatus of the first embodiment.
Figure 10A:
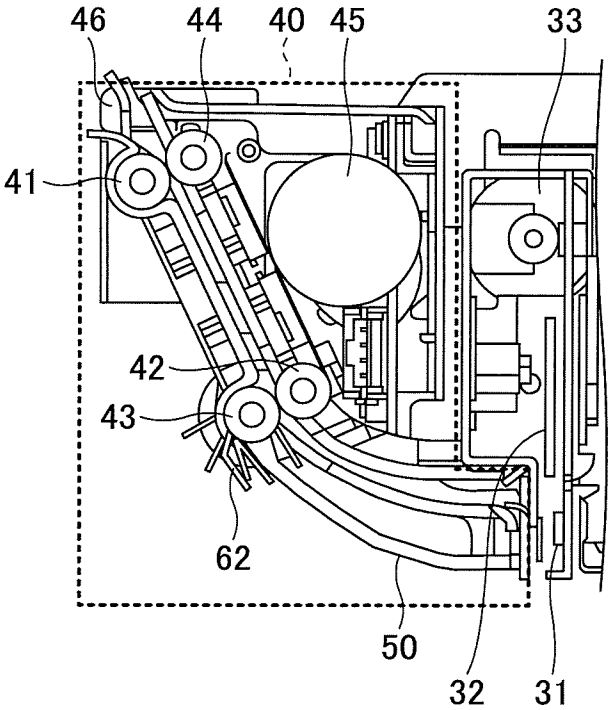

Referring to FIGS. 10A and 10B, a leaf spring 62 as an elastic body may be provided at a portion where the flapper 50 is connected with the conveying part 40. In a case where the recording paper 10 is cut for the long length, the recording paper 10 is slackened between the rollers 41, 42, 43, and 44 and the cutter part 30. The flapper 50 is pushed by the weight of the recording paper 10 against a restoring force of the leaf spring 62. Referring to FIG. 10B, the flapper 50 opens to slacken the recording paper 10. After the recording paper 10 is ejected, because the recording paper 10 pushing the flapper 50 with the weight of the recording paper 10 disappears, the flapper 50 is closed by the restoring force of the leaf spring 62. The flapper 50 is closed in FIG. 10A, and the flapper is opened in FIG. 10B.

Second Embodiment

Figure 11:
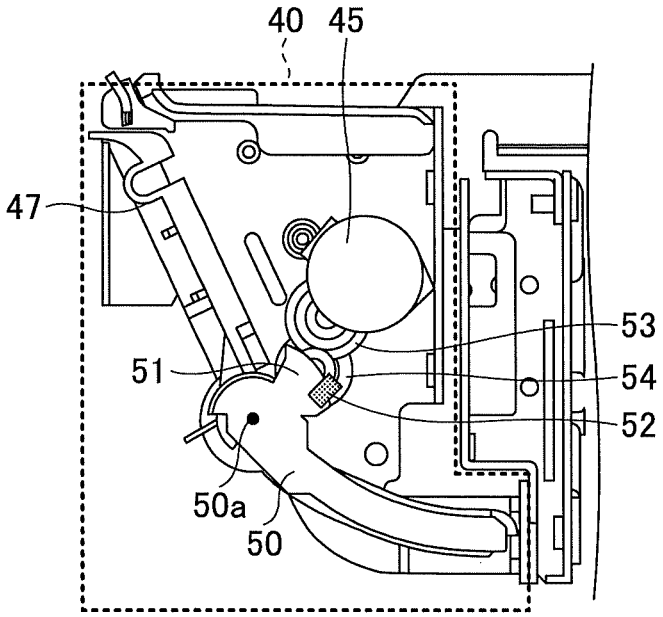
FIG. 11 illustrates a structure of a printer apparatus of a second embodiment.

The structure of a printer apparatus of a second embodiment is described next. The printer apparatus of the second embodiment detects an opening and closing state of the flapper 50. Specifically, as illustrated in FIG. 11, the flapper 50 is attached to a conveying route cover 47 of the conveying part 40 so as to be rotatable around the rotary shaft 50*a*. Further, a protrusion 51 is provided in the flapper 50, and an optical sensor 52 is provided in the vicinity of the protrusion 51. As illustrated in FIGS. 12A, 123, 13A and 13B, the optical sensor 52 includes a light emitting portion 52*a* and a light receiving portion 52*b*. Depending on whether the light emitted by the light emitting portion 52*a* is received by the light receiving portion 52*b*, whether the protrusion 51 of the flapper 50 exists as a shielding object exists or not is detected. Thus, it is possible to detect the opening and closing state of the flapper 50.

Figure 12A:
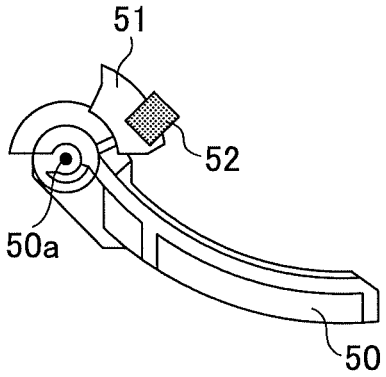
FIGS. 12A and 12B illustrate the flapper of the printer apparatus of the second embodiment.
Figure 12B:
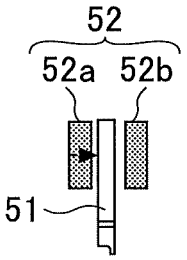

As illustrated in FIGS. 12A and 12B, under a closing state where the flapper 50 is closed, the protrusion 51 of the flapper 50 exists between the light emitting portion 52*a* and the light receiving portion 52*b*. Therefore, light emitted by the light emitting portion 52*a* is shielded by the protrusion 51 and is not received by the light receiving portion 52*b*. In a case where the light emitted by the light emitting portion 52*a* is not received by the light receiving portion 52*b*, the flapper 50 is determined to be closed.

Figure 13A:
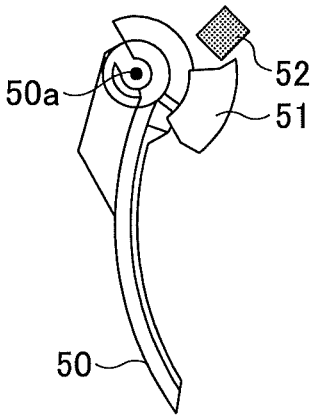
FIGS. 13A and 13B illustrate the flapper of the printer apparatus of the second embodiment.
Figure 13B:
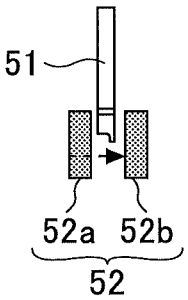

As illustrated in FIGS. 13A and 13B, under an opening state where the flapper 50 is opened, the protrusion 51 of the flapper 50 does not exist between the light emitting portion 52*a* and the light receiving portion 52*b*. Therefore, light emitted by the light emitting portion 52*a* is received by the light receiving portion 52*b*. In a case where the light emitted by the light emitting portion 52*a* is received by the light receiving portion 52*b*, the flapper 50 is determined to be open.

Further, in the second embodiment, it is also possible to detect an opening and closing state of the conveying route cover 47 of the conveying part 40 by the optical sensor 52. When the conveying route cover 47 is opened, the recording paper 10 can not conveyed by the rollers 41, 42, 43, and 44. After detecting that the conveying route cover 47 is closed, the printer apparatus is controlled to start printing operation.

Figure 14A:
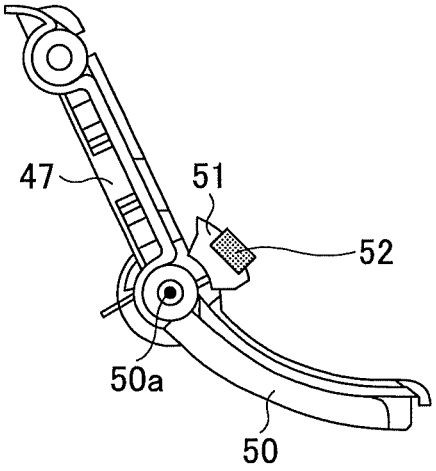
FIGS. 14A and 14B illustrates the flapper of the printer apparatus of the second embodiment.
Figure 14B:
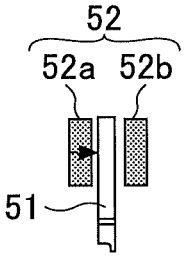

As illustrated in FIGS. 11, 14A, and 14B, when the flapper 50 is closed and the conveying route cover 47 is closed, the protrusion 51 of the flapper 50 exists between the light emitting portion 52*a* and the light receiving portion 52*b*. Therefore, light emitted by the light emitting portion 52*a* is shielded by the protrusion 51 and is not received by the light receiving portion 52*b*. Therefore, in this case, the conveying route cover 47 is determined to be closed.

Figure 15:
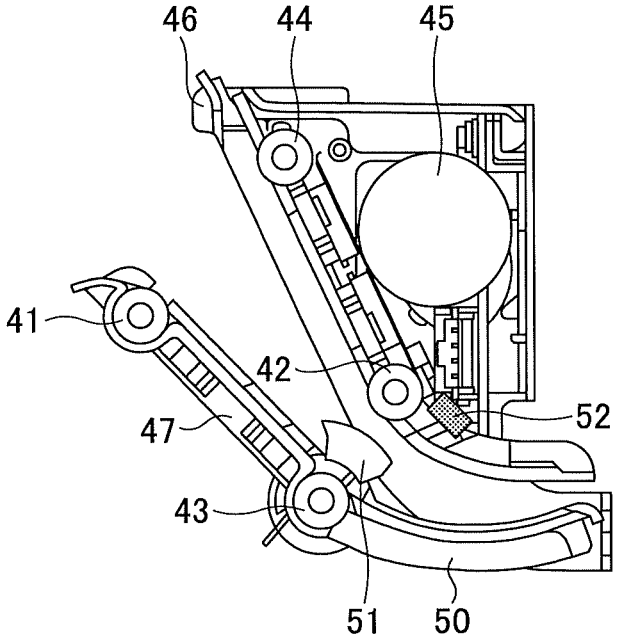
FIG. 15 illustrates the structure of the printer apparatus of the second embodiment.
Figure 16A:
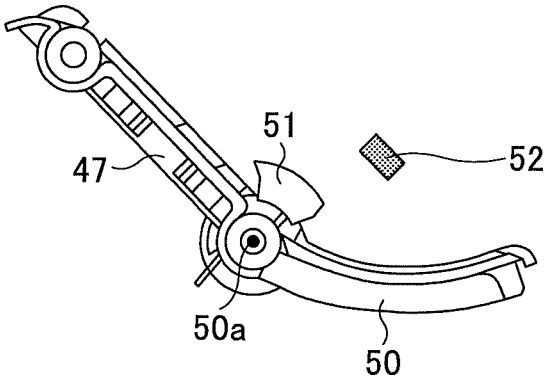
FIGS. 16A and 16B illustrate the flapper of the printer apparatus of the second embodiment.
Figure 16B:
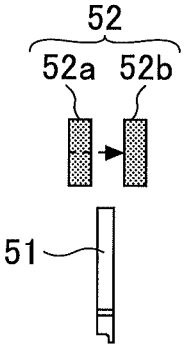

On the other hand, as illustrated in FIGS. 15, 16A, and 16B, when the flapper 50 is closed but the conveying route cover 47 is opened, the protrusion 51 of the flapper 50 does not exist between the light emitting portion 52*a* and the light receiving portion 52*b*. Therefore, light emitted by the light emitting portion 52*a* is received by the light receiving portion 52*b*. Therefore, in this case, the conveying route cover 47 is determined to be open.

Figure 17A:
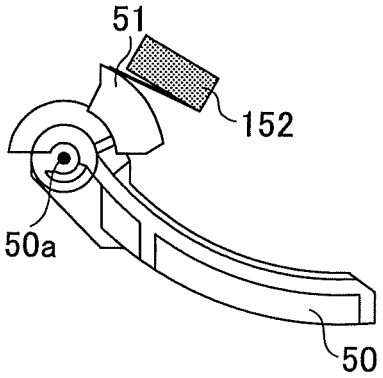
FIGS. 17A and 17B illustrate a mechanical sensor.
Figure 17B:
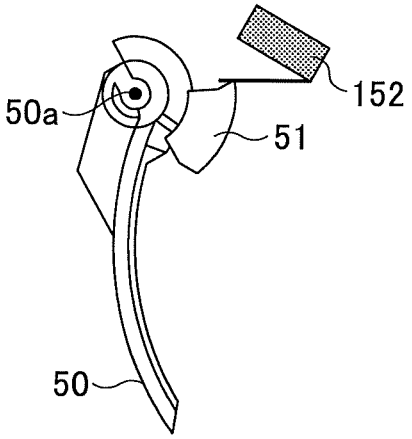

In the second embodiment, a mechanical sensor may be used instead of the optical sensor 52. As illustrated in FIGS. 17A and 17B, a mechanical sensor 152 using a mechanical switch is provided. The mechanical sensor 152 is pushed by the protrusion 51 of the flapper 50. The flapper 50 is closed and the mechanical sensor 152 is pushed in FIG. 17A, and the flapper 50 is opened and the mechanical sensor 152 is released from pushing in FIG. 17B.

The other portions of the second embodiment are similar to those described in the first embodiment.

Third Embodiment

Figure 18:
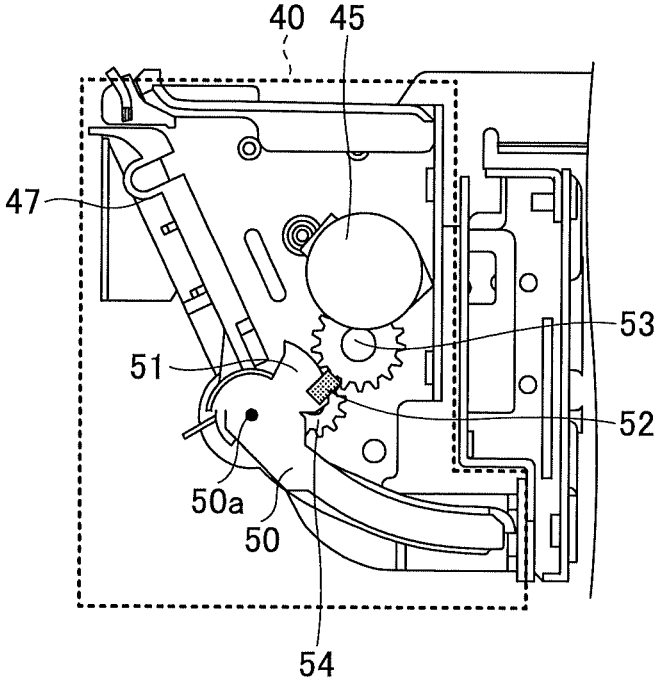
FIG. 18 illustrates a structure of a printer apparatus of a third embodiment.

A printer of a third embodiment is described next. In the third embodiment, the flapper 50 is opened or closed by a motor 45. Specifically, as illustrated in FIG. 18, gears including a first gear 53 and a second gear 54 are provided between the motor 45 and the rotary shaft 50*a* of the flapper 50. The first gear 53 is engaged with a gear provided to a rotary shaft of the motor (not illustrated in FIG. 18). The first gear 53 is engaged with the second gear 54. The second gear 54 is engaged with a gear provided to the rotary shaft 50*a* of the flapper 50 (not illustrated in FIG. 18). Therefore, the flapper 50 is opened or closed around the rotary shaft 50*a* through the first gear 53 and the second gear 54 by rotating the motor 45.

In the printer apparatus of the third embodiment, by moving the position of the second gear 54, the opening and closing operations of the flapper 50 or a conveying operation of the recording paper by the rotation of the rollers 41, 42, 43, and 44 can be switched over while using the single motor 45.

Specifically, in a case where the flapper 50 is opened or closed as illustrated in (a) of FIG. A, the second gear 54 is moved to a position so that the second gear 54 is engaged with the flapper 45. Under this state, a motor 45*a* provided to the rotary shaft of the motor 45 is engaged with the first gear 53, the first gear 53 is engaged with the second gear 54, and the second gear 54 is engaged with the flapper 45 provided to the rotary shaft 50*a* of the flapper 50. By rotating the motor 45 in the condition illustrated in FIG. 19A, the motor 45*a*, the first gear 53, the second gear 54, and the flapper 45 are rotated. Thus, the flapper 50 is rotated around the rotary shaft 50*a* and the flapper 50 is opened or closed.

Figure 19B:
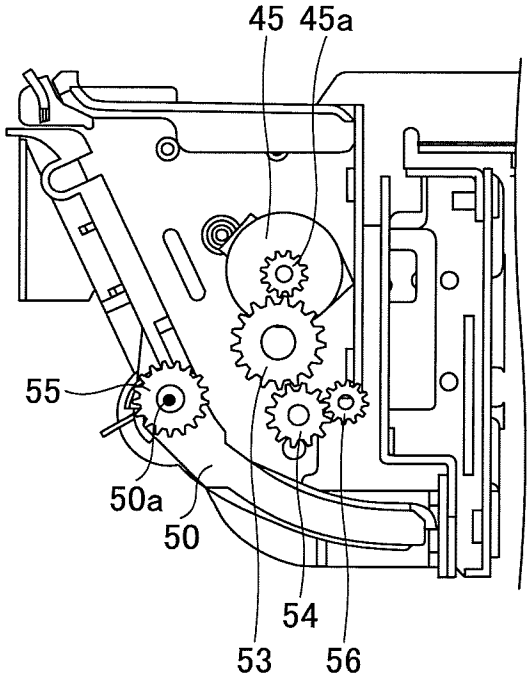
FIGS. 19A and 19B illustrate the structure of the printer apparatus of the third embodiment.
Figure 19A:
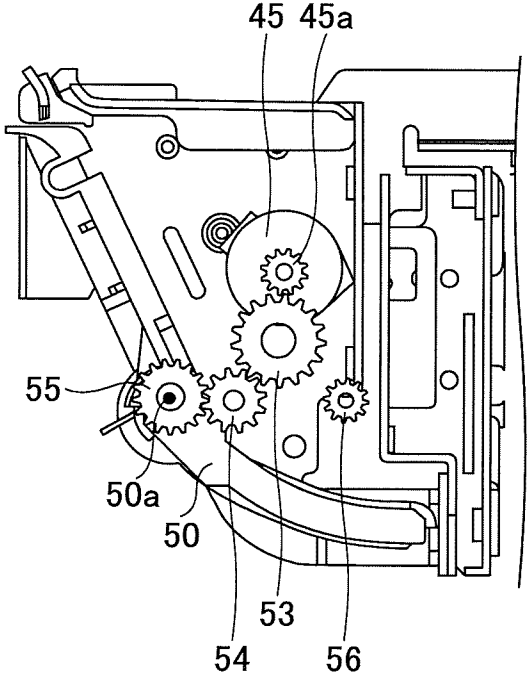

As illustrated in FIG. 19B, in a case where the recording paper 10 is conveyed, the second gear 54 is moved to a position so that the second gear 54 is engaged with the roller gear 56. The roller gear 56 is provided to rotate the rollers 41, 42, 43, and 44 (not illustrated in FIG. 19B). Another gear may be provided between the roller gear 56 and the rollers 41, 42, 43, and 44. Under this state, the motor 45*a* provided to the rotary shaft of the motor 45 is engaged with the first gear 53, the first gear 53 is engaged with the second gear 54, and the second gear 54 is engaged with the roller gear 56 provided to rotate the rollers 41, 42, 43, and 44. The motor 45*a*, the first gear 53, the second gear 54, and the roller gear 56 are rotated by rotating the motor 45. Thus, the rollers 41, 42, 43, and 44 are rotated and the recording paper 10 is conveyed by the rollers.

The other portions of the third embodiment are similar to those described in the first and second embodiments.

According to the present invention, it is possible to provide the printer apparatus by which the recording paper is cut for the long length.

All examples and conditional language recited herein are intended for pedagogical purposes to aid the reader in understanding the embodiments and the concepts contributed by the inventor to furthering the art, and are to be construed as being without limitation to such specifically recited examples and conditions, nor does the organization of such examples in the specification relate to a showing of superiority or inferiority of the embodiments. Although the printer apparatus have been described in detail, it should be understood that the various changes, substitutions, and alterations could be made hereto without departing from the spirit and scope of the invention.

What is claimed is:

1. A printer comprising:

a printing part which prints on a recording paper;

a conveying part which includes a conveying route which includes a curving area having a curving shape and through which the recording paper is conveyed, and an ejecting port, from which the recording paper is ejected;

a conveying route cover that covers a portion of the conveying route, the conveying route cover being rotatably attached to the conveying part so as to open and close the conveying route; and a flapper which has a curved shape so as to cover the curving area, and is rotatably attached to the conveying route cover so as to open or close the conveying route at the curving area, wherein the conveying route cover and the flapper are integrally movable together so as to open and close the conveying route, wherein the flapper rotates in a first direction while the conveying route cover is closed when the flapper opens the conveying route at the curving area so as to slacken the recording sheet toward an outside of the conveying route at the curving area, and wherein the conveying route cover rotates with the flapper in a second direction opposite to the first direction when the conveying route cover opens the conveying route.

2. A printer comprising:

a printing part which prints on a recording paper;

a conveying part which includes a conveying route through which the recording paper is conveyed, a pair of conveying rollers for conveying the recording paper, and an ejecting port from which the recording paper is ejected;

a conveying route cover that forms and covers a first portion of the conveying route including the ejecting port, and is rotatably attached to the conveying part so as to open and close the conveying route; and a flapper that forms and covers a second portion of the conveying route, and is rotatably attached to the conveying route cover so as to open or close the conveying route at the second portion, wherein the conveying route cover is capable of moving integrally with the flapper so as to open and close the conveying route, wherein the conveying route is opened at the second portion when the flapper rotates in a first direction while the conveying route cover is closed, wherein the conveying route is opened at both of the first portion and the second portion when the conveying route cover rotates with the flapper in a second direction opposite to the first direction, and wherein when the conveying route cover rotates in the second direction, the ejecting port is opened, and the pair of the conveying rollers are separated from each other.

3. A printer comprising:

a printing part which prints on a recording paper;

a conveying part which includes a conveying route through which the recording paper is conveyed, and an ejecting port from which the recording paper is ejected;

a conveying route cover that covers a first portion of the conveying route closer to the ejecting port, and is rotatably attached to the conveying part at its end farther from the ejecting port so as to open and close the conveying route; and a flapper that covers a second portion of the conveying route farther from the ejecting port relative to the first portion, and is rotatably attached to the conveying route cover at its end closer to the ejecting port so as to open or close the conveying route at the second portion, wherein the conveying route cover is capable of moving integrally with the flapper so as to open and close the conveying route, and wherein the conveying route can be opened in two ways, by rotating the flapper in a first direction, and by rotating the conveying route cover with the flapper in a second direction opposite to the first direction.

* * * * *